US009045872B2

(12) United States Patent
Wahl et al.

(10) Patent No.: US 9,045,872 B2
(45) Date of Patent: Jun. 2, 2015

(54) EXCHANGEABLE SWEEPING BRUSH DEVICE AND SWEEPER HAVING SUCH A SWEEPING BRUSH DEVICE

(75) Inventors: Joachim Wahl, Spiegelberg-Jux (DE); Bernd Haberl, Weissach im Tal (DE); Uwe Weller, Allmersbach im Tal (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/231,102

(22) Filed: Sep. 13, 2011

(65) Prior Publication Data

US 2012/0124760 A1 May 24, 2012

Related U.S. Application Data

(63) Continuation of application No. PCT/EP2010/052908, filed on Mar. 8, 2010.

(30) Foreign Application Priority Data

Mar. 16, 2009 (DE) ..... 10 2009 014 560

(51) Int. Cl.
*E01H 1/05* (2006.01)
*A47L 11/24* (2006.01)
*A46B 15/00* (2006.01)

(52) U.S. Cl.
CPC ..... *E01H 1/053* (2013.01)

(58) Field of Classification Search
CPC ..... E01H 1/053; A47L 11/4055; A47L 11/24; A47L 11/4052; A47L 11/28; A47L 11/4038; A47L 11/16
USPC ..... 15/49.1, 340.1, 340.3, 340.4, 87
IPC ..... A47L 11/16, 11/24, 11/206, 11/283, A47L 11/293; E01H 1/05; A01B 63/108; B62D 49/06
See application file for complete search history.

(56) References Cited

U.S. PATENT DOCUMENTS 1,452,307 A * 4/1923 Martin ..... 15/87
1,546,071 A * 7/1925 Harris ..... 15/87
(Continued)

FOREIGN PATENT DOCUMENTS

DE 930948 7/1955
DE 8617171 11/1986
(Continued)

OTHER PUBLICATIONS

Tennant Company brochure entitled 5400 Automatic Scrubber, 2004, 4 pages.
(Continued)

*Primary Examiner* — Joseph J Hail
*Assistant Examiner* — Marc Carlson
(74) *Attorney, Agent, or Firm* — Lipsitz & McAllister, LLC

(57) ABSTRACT

An exchangeable sweeping brush device for a carrier vehicle is provided. The device has at least one sweeping brush which is rotationally drivable about an almost vertically oriented axis of rotation of the brush and is held on a supporting frame, the supporting frame being detachably connectable to a supporting fork of the carrier vehicle, which is pivotable about a first horizontal pivot axis oriented transversely to the longitudinal axis of the vehicle. The supporting frame comprises a first supporting assembly on which the at least one sweeping brush is rotatably mounted, and a second supporting assembly which is detachably connectable to the supporting fork, the first supporting assembly being connected to the second supporting assembly for pivotal movement about a second horizontal pivot axis and being detachably connectable to the carrier vehicle by at least one tension member. A sweeper having such a sweeping brush device is also proposed.

17 Claims, 6 Drawing Sheets

(56) References Cited

U.S. PATENT DOCUMENTS

| | | | | | |
|---|---|---|---|---|---|
| 2,558,623 | A | * | 6/1951 | Mott | 15/87 |
| 2,672,634 | A | | 3/1954 | Burnham | |
| 2,708,280 | A | * | 5/1955 | Antos et al. | 15/83 |
| 2,917,761 | A | | 12/1959 | Burgdorff | |
| 3,292,195 | A | * | 12/1966 | Schmidt et al. | 15/87 |
| 3,316,578 | A | * | 5/1967 | Tamny | 15/87 |
| 3,353,199 | A | * | 11/1967 | Palmiter et al. | 15/87 |
| 3,401,416 | A | | 9/1968 | Ziegler | |
| 3,459,109 | A | * | 8/1969 | Ingleright | 404/87 |
| 3,634,904 | A | | 1/1972 | Larsen | |
| D228,362 | S | | 9/1973 | Krier et al. | |
| 3,790,981 | A | * | 2/1974 | Young | 15/87 |
| D231,387 | S | | 4/1974 | Krier et al. | |
| 3,942,218 | A | | 3/1976 | Krier et al. | |
| 3,959,010 | A | | 5/1976 | Thompson et al. | |
| 4,183,116 | A | | 1/1980 | Thompson | |
| 4,317,252 | A | | 3/1982 | Knowlton | |
| 4,335,482 | A | * | 6/1982 | Jones | 15/87 |
| 4,364,138 | A | * | 12/1982 | Waldhauser et al. | 15/50.1 |
| D281,109 | S | | 10/1985 | van Raaij | |
| D281,633 | S | | 12/1985 | Pratt | |
| D281,634 | S | | 12/1985 | Pratt | |
| D291,932 | S | | 9/1987 | Knowlton et al. | |
| 4,754,521 | A | | 7/1988 | Zoni | |
| 4,779,303 | A | | 10/1988 | Duthie et al. | |
| 4,799,282 | A | | 1/1989 | Fischer | |
| 4,903,368 | A | | 2/1990 | Duthie et al. | |
| 5,243,727 | A | | 9/1993 | Tanaka et al. | |
| 5,259,085 | A | | 11/1993 | Marafante et al. | |
| 5,421,053 | A | | 6/1995 | Chodak | |
| 5,715,567 | A | * | 2/1998 | Tagliaferri | 15/340.3 |
| D391,697 | S | | 3/1998 | Knowlton et al. | |
| 5,771,532 | A | | 6/1998 | Munnoch | |
| 5,991,951 | A | * | 11/1999 | Kubo et al. | 15/50.1 |
| 6,070,290 | A | | 6/2000 | Schwarze et al. | |
| 6,088,873 | A | * | 7/2000 | Pacchini et al. | 15/320 |
| 6,154,920 | A | | 12/2000 | Petrole et al. | |
| 6,163,923 | A | * | 12/2000 | Hefter | 15/340.4 |
| 6,530,102 | B1 | * | 3/2003 | Pierce et al. | 15/52.1 |
| 6,675,424 | B2 | * | 1/2004 | Smith et al. | 15/87 |
| 6,836,919 | B2 | * | 1/2005 | Shinler | 15/78 |
| 7,013,527 | B2 | * | 3/2006 | Thomas et al. | 15/319 |
| 7,059,004 | B2 | * | 6/2006 | Mitchell et al. | 15/50.1 |
| 7,441,303 | B2 | * | 10/2008 | Adair et al. | 15/340.3 |
| 7,587,779 | B2 | | 9/2009 | Walz et al. | |
| 7,765,630 | B2 | * | 8/2010 | Flora et al. | 15/82 |
| D642,343 | S | * | 7/2011 | Dammkoehler | D32/16 |
| 8,136,193 | B2 | * | 3/2012 | Larkowski et al. | 15/87 |
| 8,234,749 | B2 | * | 8/2012 | Mitchell et al. | 15/340.3 |
| 2002/0138939 | A1 | * | 10/2002 | Smith et al. | 15/340.4 |
| 2002/0179116 | A1 | * | 12/2002 | Shinler | 134/6 |
| 2003/0000549 | A1 | * | 1/2003 | Joynt et al. | 134/6 |
| 2004/0025270 | A1 | * | 2/2004 | Mitchell et al. | 15/52.1 |
| 2005/0246845 | A1 | * | 11/2005 | Duncan et al. | 15/49.1 |
| 2008/0216259 | A1 | * | 9/2008 | Walz et al. | 15/49.1 |
| 2010/0197210 | A1 | * | 8/2010 | Goldberg et al. | 451/353 |
| 2010/0325824 | A1 | * | 12/2010 | Baum et al. | 15/87 |
| 2012/0060319 | A1 | * | 3/2012 | Wahl et al. | 15/322 |
| 2012/0124760 | A1 | * | 5/2012 | Wahl et al. | 15/49.1 |

FOREIGN PATENT DOCUMENTS

| | | | | | |
|---|---|---|---|---|---|
| DE | 91 04 224 | | | 9/1991 | |
| DE | 9409379 | U1 | * | 6/1994 | |
| DE | 94 09 379 | | | 8/1994 | |
| DE | 44 14 628 | | | 10/1995 | |
| DE | 19522019 | | | 4/1997 | |
| DE | 20112322 | | | 11/2001 | |
| DE | 101 18 500 | | | 8/2002 | |
| DE | 4434520 | | | 5/2005 | |
| DE | 10 2005 018 882 | | | 11/2006 | |
| EP | 0 021 784 | | | 1/1981 | |
| EP | 0251987 | | | 1/1991 | |
| EP | 0487892 | | | 6/1992 | |
| EP | 0 945 551 | | | 9/1999 | |
| EP | 945551 | A1 | * | 9/1999 | E01H 1/05 |
| EP | 1 061 180 | | | 12/2000 | |
| EP | 1061180 | A1 | * | 12/2000 | E01H 1/05 |
| EP | 1279363 | | | 1/2003 | |
| EP | 1 516 965 | | | 3/2005 | |
| EP | 1714603 | A1 | * | 10/2006 | |
| EP | 1 772 563 | | | 4/2007 | |
| EP | 1 772 564 | | | 5/2008 | |
| EP | 1 967 653 | | | 9/2008 | |
| EP | 1 988 214 | | | 11/2008 | |
| FR | 2 901 289 | | | 11/2007 | |
| FR | 2901289 | A1 | * | 11/2007 | E01H 1/05 |
| FR | 2 912 434 | | | 8/2008 | |
| GB | 2 420 813 | | | 6/2006 | |
| JP | H05300860 | A | * | 11/1993 | A47L 11/24 |
| JP | 08280592 | | | 10/1996 | |
| JP | 2002065538 | | | 3/2002 | |
| JP | 2006034984 | A | * | 2/2006 | |
| JP | 2010035773 | A | * | 2/2010 | |
| WO | WO 8809848 | A1 | * | 12/1988 | E01H 1/08 |
| WO | 9842245 | | | 10/1998 | |
| WO | 03053206 | | | 7/2003 | |
| WO | 2009/014511 | | | 1/2009 | |
| WO | WO 2009014511 | A1 | * | 1/2009 | B24B 7/18 |

OTHER PUBLICATIONS

Extract for catalog of Alfred Kaercher GmbH & Co. KG, "Programme 2005", cover, pp. 213-215, 218-219 and last page, (Dec. 2004).

Extract from catalog of Alfred Kaercher GmbH & Co. KG, "Programme 2006" cover, pp. 232-233, 236-237 and last page (Dec. 2005).

Extract from catalog of Alfred Kaercher GmbH & Co. KG, "Programme 2007", cover, pp. 253-257, 261-263 and last page (Jan. 2007).

Extract from catalog of Alfred Kaercher GmbH & Co. KG, "Programme 2008", cover, pp. 269-273, 277-279, 281 and last page (Dec. 2007).

Extract from catalog of Alfred Kaercher GmbH & Co. KG, "Programme 2009 Kaercher Industrial", cover, p. 35 and last page (Mar. 2009).

* cited by examiner

EXCHANGEABLE SWEEPING BRUSH DEVICE AND SWEEPER HAVING SUCH A SWEEPING BRUSH DEVICE

This application is a continuation of international application number PCT/EP2010/052908 filed on Mar. 8, 2010 and claims the benefit of German application number 10 2009 014 560.5 filed on Mar. 16, 2009.

The present disclosure relates to the subject matter disclosed in international application number PCT/EP2010/052908 of Mar. 8, 2010 and German application number 10 2009 014 560.5 of Mar. 16, 2009, which are incorporated herein by reference in their entirety and for all purposes.

BACKGROUND OF THE INVENTION

The invention relates to an exchangeable sweeping brush device for a carrier vehicle having at least one sweeping brush which is rotationally drivable about an almost vertically oriented axis of rotation of the brush and is held on a supporting frame, the supporting frame being detachably connectable to a supporting fork of the carrier vehicle, which is pivotable about a first horizontal pivot axis oriented transversely to the longitudinal axis of the vehicle.

The invention also relates to a sweeper having a chassis and a supporting fork which is coupled to the chassis and is pivotable about a first horizontal pivot axis oriented transversely to the longitudinal axis of the vehicle, and having a sweeping brush device of the aforementioned kind, which is detachably connectable to the supporting fork.

Carrier vehicles are known, which have at their front side a supporting fork on which a sweeping brush device may be held for sweeping a ground surface of, for example, a street or a pavement. The carrier vehicle may accommodate a suction device, with which the sweepings can be taken up from the ground surface and transferred into a dirt container. Instead of a sweeping brush device, some other device may be fixed to the supporting fork at the front side, for example, a snow plough or a shovel. The sweeping brush device should, therefore, be connectable to the supporting fork and, when required, detachable from it as easily as possible. For this purpose, the sweeping brush device comprises a supporting frame. The at least one sweeping brush is held on the supporting frame so as to be rotationally drivable about an almost vertically oriented axis of rotation of the brush.

The supporting fork is usually able to be pivoted about a first horizontal pivot axis oriented transversely to the longitudinal axis of the vehicle. This makes it possible to adjust the position of the at least one sweeping brush relative to the ground surface. Pivoting of the supporting fork does, however, cause the orientation of the sweeping brush to be changed and hence also the area of the ground surface to be cleaned with which the sweeping brush comes into engagement. It is, therefore, desirable for the at least one sweeping brush to be able to be adjusted parallel to the ground surface.

It is, therefore, an object of the present invention to further develop a sweeping brush device of the kind mentioned at the outset so that it can be connected to the supporting fork of the carrier vehicle, and, when required, detached from it in a simple way, with the at least one sweeping brush being able to be adjusted parallel to the ground surface by pivoting the supporting fork.

It is also an object of the invention to provide a sweeper of the kind mentioned at the outset having such a sweeping brush device.

SUMMARY OF THE INVENTION

With an exchangeable sweeping brush device of the generic kind, the object set forth above is accomplished in that the supporting frame comprises a first supporting assembly on which the at least one sweeping brush is mounted for rotation, and a second supporting assembly which is detachably connectable to the supporting fork, the first supporting assembly being connected to the second supporting assembly for pivotal movement about a second horizontal pivot axis and being detachably connectable to the carrier vehicle by at least one tension member.

A supporting frame with a first supporting assembly and a second supporting assembly is employed in the sweeping brush device in accordance with the invention. The second supporting assembly is detachably connectable to the supporting fork, which is pivotable about a first horizontal pivot axis oriented transversely to the longitudinal axis of the vehicle. The first supporting assembly is pivotably connected to the second supporting assembly, and it may be pivoted about a second horizontal pivot axis relative to the second supporting assembly. In addition, the first supporting assembly is detachably connectable directly to the carrier vehicle by a tension member. Such a configuration has the advantage that the sweeping brush device can be connected to the carrier vehicle in a very simple way. To do so, only the second supporting assembly need be connected to the supporting fork, and, in addition, the at least one tension member has to be brought into contact with the first supporting assembly. By pivoting the supporting fork about the first horizontal pivot axis, the second supporting assembly directly connected to the supporting fork can be pivoted in order to raise and lower the at least one sweeping brush. The first supporting assembly is pivotably coupled to the second supporting assembly and directly connectable to the carrier vehicle by the tension member. As a result, upon pivoting the supporting fork, the inclination of the first supporting assembly relative to the second supporting assembly can be changed, so that the at least one sweeping brush can be moved parallel to the ground surface. For, the supporting fork forms in combination with the at least one tension member and the two supporting assemblies a parallelogram guide for the at least one sweeping brush, so that when the supporting fork is pivoted about the first horizontal pivot axis, the sweeping brush can be moved parallel to the ground surface. This makes it possible to change the position of the sweeping brush relative to the ground surface in a simple way in order to thereby obtain a cleaning result which is as optimal as possible. This merely requires the supporting fork to be pivoted about the first horizontal pivot axis.

With the sweeping brush device in accordance with the invention, the at least one sweeping brush can be moved parallel to the ground surface by pivotal movement of the supporting fork, without a complex guiding mechanism that is not easy to detachably connect to the supporting fork having to be used to do so. The sweeping brush device in accordance with the invention is, therefore, distinguished, on the one hand, by the at least one sweeping brush being easily movable parallel to the ground surface, and, on the other hand, by the sweeping brush device being very easily connectable to and detachable from the supporting fork.

The at least one sweeping brush may assume a defined orientation and a predetermined position relative to the ground surface, without the supporting frame of the sweeping brush device having to be supported by additional support elements on the ground surface. Such support elements impair the cleaning result for there is a danger that while traveling over the ground surface they will press sweepings against the ground surface, which can then only be removed with difficulty from the ground surface by the at least one sweeping brush. This applies to damp foliage, for example, which is pressed by the support elements against the ground surface. Such support elements may be dispensed with in the sweeping brush device in accordance with the invention, as the at least one sweeping brush may be optimally adjusted owing to its parallel movability relative to the ground surface. To do so, it is merely necessary to pivot the supporting fork about the first horizontal pivot axis. Such pivotability of the supporting fork is standard in carrier vehicles that are in common use.

The tension member may, for example, take the form of a rope or a chain, which, for example, may be fastened, on the one hand, to the chassis of the carrier vehicle and, on the other hand, to the first supporting assembly.

In a preferred embodiment, the contact pressure which the at least one sweeping brush exerts on the ground surface that is to be cleaned is adjustable. The contact pressure can thus be adapted to the respective ground surface that is to be cleaned in order to obtain a cleaning result that is as optimal as possible.

It is particularly advantageous if the first supporting assembly is pivotable about the second horizontal pivot axis against a spring-elastic restoring force. This makes it possible to act upon the first supporting assembly and hence also on the at least one sweeping brush which is rotatably mounted on the first supporting assembly with a spring force in the direction towards the ground surface that is to be cleaned.

It is advantageous if the strength of the spring-elastic restoring force is adjustable because the contact pressure which the at least one sweeping brush exerts on the ground surface that is to be cleaned may then be easily adjusted.

In an advantageous configuration, the first supporting assembly comprises a tension member holder, which is connectable to the tension member at a distance from the second horizontal pivot axis, and which is coupled by a spring element to the second supporting assembly. The tension member holder thus forms an articulation point for the tension member, by means of which the first supporting assembly is directly connectable to the carrier vehicle. In addition, the tension member holder forms a counter bearing for a spring element by means of which the tension member holder is coupled to the second supporting assembly. The spring element is supported, on the one hand, on the second supporting assembly and, on the other hand, on the tension member holder of the first supporting assembly and can thereby act upon the first supporting assembly with a spring-elastic restoring force.

The spring element is expediently configured as a compression spring. In particular, a helical spring may be used for this purpose.

The spring force of the compression spring is preferably adjustable. For this purpose, it may, for example, be provided that the compression spring is clamped between the tension member holder of the first supporting assembly and a spring holder of the second supporting assembly, with the distance of the spring holder from the tension member holder being adjustable. By adjusting the distance between the spring holder and the tension member holder, the spring force which the compression spring exerts on these two parts may be changed and adjusted.

It is advantageous if the pivotability of the first supporting assembly relative to the second supporting assembly is limited. With such a configuration, the first supporting assembly can be pivoted through a maximum pivot angle about the second horizontal pivot axis relative to the second supporting assembly. After the maximum pivot angle is reached, further pivotal movement of the first supporting assembly relative to the second supporting assembly is no longer possible. This has the advantage that the at least one sweeping brush, starting from a sweeping position in which it contacts the ground surface for sweeping purposes, may, by pivoting the supporting fork about the first horizontal pivot axis, first be raised parallel to the ground surface by the inclination which the first supporting assembly assumes relative to the second supporting assembly being able to be corrected by pivoting the first supporting assembly about the second horizontal pivot axis. The pivotal movement of the first supporting assembly about the second horizontal pivot axis required to do so is, however, limited, so that when the maximum pivot angle is reached, further pivoting of the supporting fork about the first horizontal pivot axis results in the first supporting assembly directly following the movement of the second supporting assembly rigidly coupled to the supporting fork. The initially existing parallel movability of the at least one sweeping brush relative to the ground surface is thus deactivated when the maximum pivot angle is reached. This, in turn, results in the at least one sweeping brush together with the first and second supporting assemblies being able to be raised to a considerable extent by pivoting the supporting fork, in order to finally assume a position of rest in which the at least one sweeping brush assumes a considerable distance from the ground surface. Owing to the limitation of the pivotability of the first supporting assembly relative to the second supporting assembly, the at least one sweeping brush can thus be transferred from its sweeping position to its position of rest by an initial parallel raising of the sweeping brush and a subsequent tilting of the sweeping brush about the first horizontal pivot axis.

To limit the pivotability of the first supporting assembly, it may be provided that the second supporting assembly comprises a stop against which the first supporting assembly comes to bear when it reaches a maximum pivot angle. When the supporting fork is pivoted about the first horizontal pivot axis, the second supporting assembly, owing to its rigid connection with the supporting fork, follows the pivotal movement of the supporting fork, whereas the first supporting assembly, owing to its pivotability about the second horizontal pivot axis and its direct coupling to the carrier vehicle by means of the at least one tension member, initially only changes its inclination relative to the second supporting assembly, so that the at least one sweeping brush is moved parallel to the ground surface. However, the change in inclination of the first supporting assembly relative to the second supporting assembly can only take place until a maximum pivot angle of the first supporting assembly about the second horizontal axis is reached. In this position, the first supporting assembly comes to bear against a stop of the second supporting assembly. Upon further pivoting of the supporting fork and of the second supporting assembly rigidly coupled to it about the first horizontal pivot axis, the first supporting assembly then also directly follows this pivotal movement. The distance of the first supporting assembly from the stop of the second supporting assembly thus prescribes the pivotability of the first supporting assembly.

It may be provided that the sweeping brush device comprises only a single sweeping brush. This may, for example, be configured as a disc brush. It is, however, particularly advantageous if the sweeping brush device comprises two sweeping brushes, preferably two disc brushes, the axes of rotation of which brushes are slightly inclined to the vertical. The inclination of the axes of rotation of the brushes to the vertical determines the area of the sweeping brushes in which these contact the ground surface, i.e., the so-called sweeping area. Since the two sweeping brushes, starting from their sweeping position, can first be moved parallel to the ground surface, a constant sweeping area is ensured during the initial pivoting of the supporting fork about the first horizontal pivot axis.

In an advantageous embodiment of the invention, the first supporting assembly comprises a first cross member, at each end of which a retaining arm, carrying a sweeping brush, is pivotable about a vertical pivot axis. The provision of the pivotable retaining arms makes it possible to pivot the sweeping brushes in the direction of the longitudinal axis of the vehicle upon occurrence of an obstacle, so that they can avoid the obstacle. Here it is expedient for the retaining arms to be pivotable in the direction towards the longitudinal axis of the vehicle against the action of a spring-elastic restoring force. The spring force thus presses the retaining arms outwards, and, upon occurrence of an obstacle, the retaining arms and the sweeping brush fixed to each of these can evade the obstacle against the spring-elastic restoring force.

In an advantageous embodiment of the invention, the first cross member is rigidly connected to two longitudinal members, which are mounted on the second supporting assembly for pivotal movement about the second horizontal pivot axis. The two longitudinal members thus each form a bearing for the first supporting assembly, by means of which the first supporting assembly is coupled to the second supporting assembly.

Expediently, the two longitudinal members are rigidly connected to each other by a second cross member, with the second horizontal pivot axis extending between the first cross member and the second cross member. The first supporting assembly is thus suspended by means of the two longitudinal members so as to swing on the second supporting assembly. At a front end, the longitudinal members are rigidly connected to the first cross member, which may carry a sweeping brush at each of its ends. At their rear end, the two longitudinal members are rigidly coupled to each other by the second cross member, and in the region between the first cross member and the second cross member, the longitudinal members are each mounted on the second supporting assembly for pivotal movement about the second horizontal pivot axis.

In an advantageous embodiment of the invention, the second cross member is rigidly connected to a tension member holder, the tension member being connectable to the free end of the tension member holder projecting from the second cross member. The tension member holder may, for example, be oriented transversely to the longitudinal axis of the second cross member and carry at its free end a hook or an eyelet, to which the at least one tension member may be fastened.

It may be provided that the tension member holder is adapted to bear against a stop of the second supporting assembly after pivoting of the first supporting assembly through a maximum pivot angle. The tension member holder may thus serve as component which limits the pivotability of the first supporting assembly relative to the second supporting assembly.

As explained above, it is advantageous for the first supporting assembly to be held so as to swing on the second supporting assembly. By means of a spring element, the first supporting assembly may be acted upon with a restoring force, which compensates the torque applied by the at least one sweeping brush relative to the swing axis, i.e., to the second horizontal pivot axis, to such an extent that the at least one sweeping brush exerts a prescribable contact pressure on the ground surface.

In an advantageous embodiment of the invention, the second supporting assembly comprises a transverse member, which is adapted to be placed on the free end regions of the supporting fork, and on which the first supporting assembly is mounted for pivotal movement about the second horizontal pivot axis. The transverse member enables a rigid coupling of the second supporting assembly to the supporting fork. The second supporting assembly thus directly follows a pivotal movement of the supporting fork about the first horizontal pivot axis.

It may be provided that the supporting fork comprises prongs, which each have at their free end a vertically upwardly projecting pin, which passes through an opening in the transverse member. The upwardly projecting pins of the supporting fork thus enable the position of the transverse member relative to the supporting fork to be easily secured.

The transverse member preferably comprises receptacles, which each receive a free end region of a prong of the supporting fork. The receptacles may, for example, be of U-shaped cross section and may be placed from above onto the free end regions of the prongs.

Expediently, the transverse member forms a stop, which limits the pivotability of the first supporting assembly relative to the second supporting assembly.

The transverse member may, for example, carry a spring holder, which is coupled to the first supporting assembly by a spring element. The spring holder may, for example, take the form of a spring bolt, which projects from the transverse member in coaxial alignment with the longitudinal axis of the vehicle and passes through a helical line-shaped spring which is supported, on the one hand, on a bolt head of the spring bolt and, on the other hand, on the first supporting assembly and thereby exerts a spring-elastic restoring force between the first supporting assembly and the second supporting assembly.

As already mentioned at the outset, the invention also relates to a sweeper having a chassis and a supporting fork which is coupled to the chassis and is pivotable about a first horizontal pivot axis, and having a sweeping brush device of the aforementioned kind, which is detachably connectable to the supporting fork. To ensure that the at least one sweeping brush can be moved parallel to the ground surface by pivoting the supporting fork about the first horizontal pivot axis, it is provided, in accordance with the invention, that at least one fastening element is held on the chassis for connecting the at least one tension member to the chassis. The supporting fork is pivotable about the first horizontal pivot axis relative to the chassis. A drive unit of the carrier vehicle is used for this purpose, for example, a hydraulic or pneumatic piston-cylinder unit. The second supporting assembly of the sweeping brush device is detachably connectable to the supporting fork, but it may be rigidly coupled to the supporting fork. A pivotal movement of the supporting fork is thus transmitted to the second supporting assembly, i.e., the second supporting assembly follows the pivotal movement of the supporting fork. In order that the orientation of the first supporting assembly may be corrected during the pivoting of the second supporting assembly, so that the orientation of the axes of rotation of the brushes relative to the vertical remains unchanged, the first supporting assembly held so as to swing on the second supporting assembly may be directly coupled to the chassis by the at least one tension member. A fastening element is held on the chassis for this purpose.

The fastening element may, for example, take the form of a lug, a hook or an eyelet, to which the at least one tension member, for example, a chain or a rope, may be fastened.

It is particularly advantageous if a supporting part is held on the chassis for pivotal movement about the first horizontal pivot axis, and the supporting fork is mounted on the supporting part for pivotal movement about a third horizontal pivot axis oriented parallel to the longitudinal axis of the vehicle.

This makes it possible to pivot the supporting fork together with the supporting part about the first horizontal pivot axis oriented transversely to the longitudinal axis of the vehicle, so that the sweeping brush device held on the supporting fork may be raised. In addition, the supporting fork may be pivoted about a third horizontal pivot axis relative to the supporting part. The third horizontal pivot axis is oriented parallel to the longitudinal axis of the vehicle. This makes it possible to pivot the supporting fork and thus also the sweeping brush device held on it about a pivot axis oriented coaxially with the longitudinal axis of the vehicle. Inclinations of the ground surface transverse to the longitudinal axis of the vehicle can thereby be compensated.

The following description of a preferred embodiment of the invention serves for a more detailed explanation in conjunction with the drawings.

DETAILED DESCRIPTION OF THE INVENTION

Figure 1:
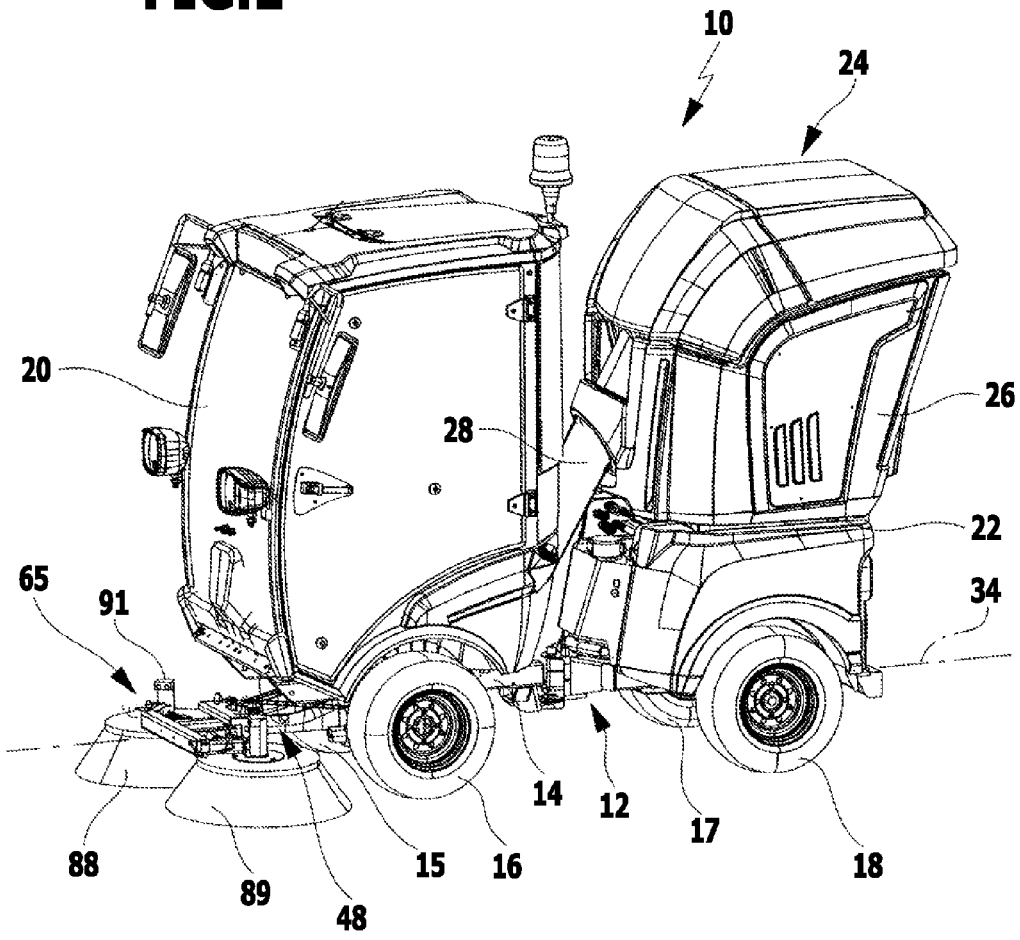
FIG. 1 shows a perspective representation of a sweeper with a supporting fork on which a sweeping brush device is detachably held.
Figure 2:
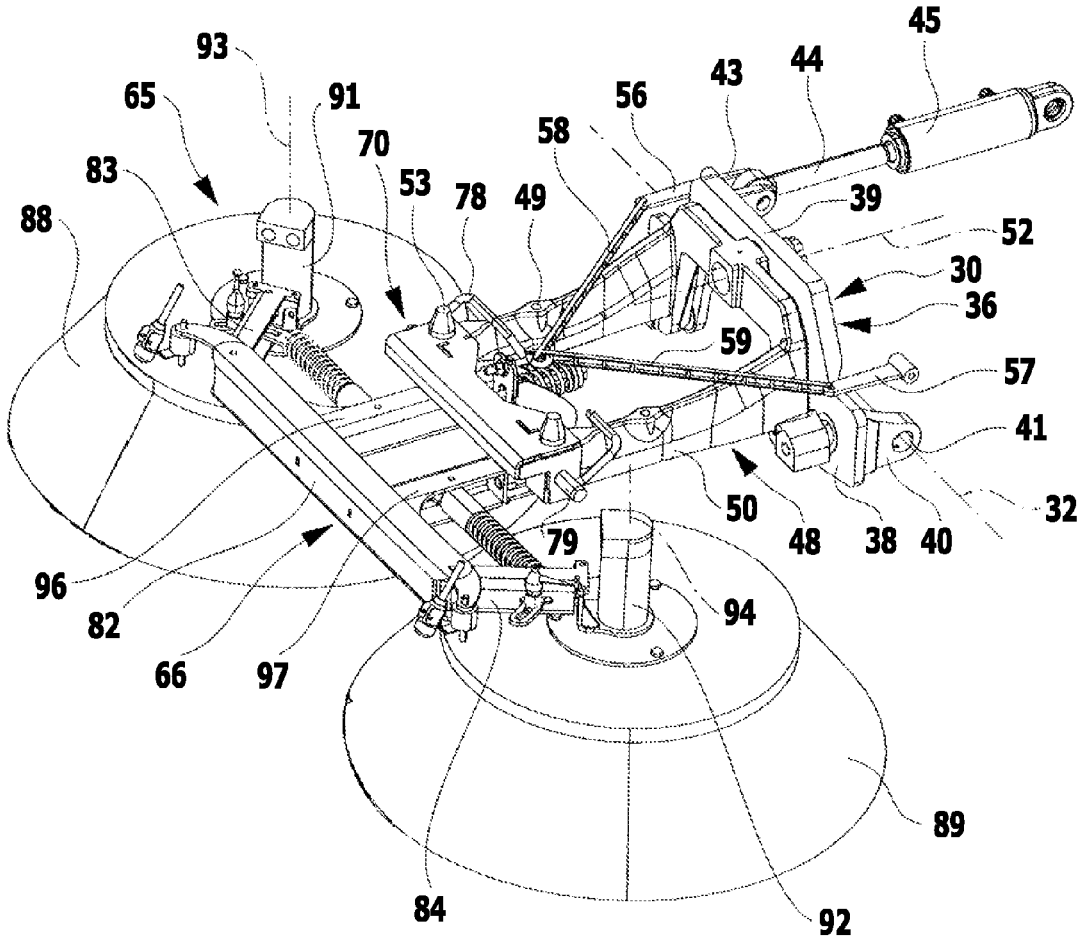
FIG. 2 shows a perspective representation of the supporting fork with the sweeping brush device held on it, when seen at an angle from the front.
Figure 3:
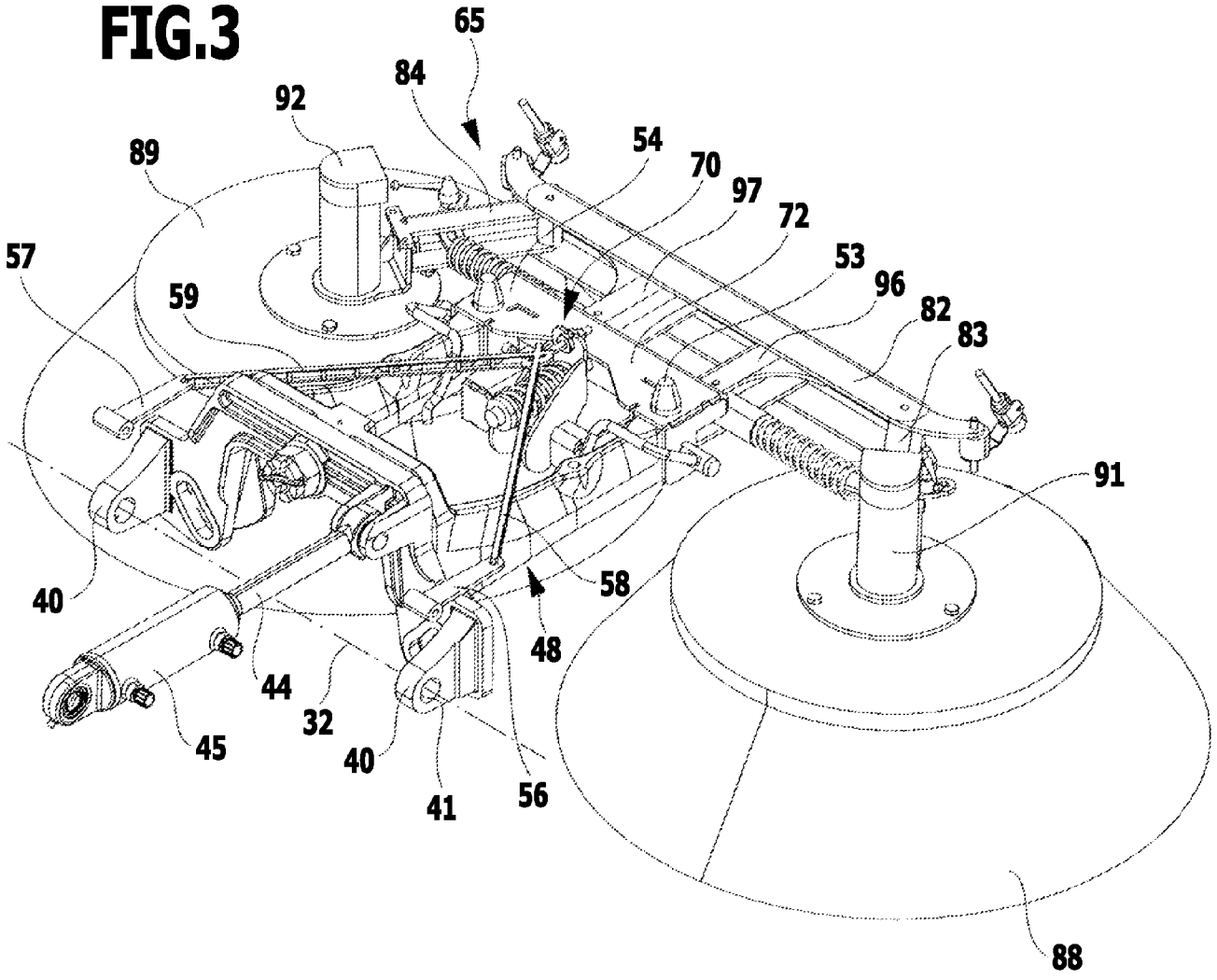
FIG. 3 shows a perspective representation of the supporting fork with the sweeping brush device held on it, when seen at an angle from the rear.

A self-propelled sweeper 10 is shown diagrammatically in FIG. 1. It comprises a carrier vehicle 12 with a chassis 14. Mounted on the chassis 14 are two steerable front wheels 15, 16 and rear wheels 17, 18 rotatable about a common axis of rotation. The carrier vehicle 12 has a driver's cab 20 above the front wheels 15, 16, and above the rear wheels 17, 18 there is located a supporting surface 22 on which a dirt intake device 24 is placed with a dirt container 26 and a suction unit, known per se and not discernible from the drawings, by means of which the dirt container 26 can be subjected to negative pressure.

Arranged between the two front wheels 15, 16 is a suction mouth, known per se, and, therefore, for better clarity not shown in the drawings, which is connected by a suction hose 28 to the dirt container 26. This makes it possible to suck up sweepings with the suction mouth from a ground surface that is to be cleaned and to transfer these through the suction hose 28 into the dirt container 26.

A substantially U-shaped supporting part 30 is mounted on the chassis 14 for pivotal movement about a first horizontal pivot axis 32. The first horizontal pivot axis 32 is oriented transversely to the longitudinal axis 34 of the carrier vehicle 12. The supporting part 30 comprises a supporting bracket 36 with a first leg 37 and a second leg 38, which are integrally connected to each other by a bridge 39. A bearing block 40 with a bearing eye 41 is held at each of the rear sides of the free ends of the legs 37 and 38. A shaft, not shown in the drawings, which is rigidly connected to the chassis 14 and defines the first horizontal pivot axis 32, passes through the bearing eyes 41.

In the area of transition between the bridge 39 and the second leg 38, there is formed on the supporting bracket 36 a further bearing block 43, which is rotatably connected to the piston rod 44 of a hydraulic piston-cylinder unit 45. The supporting part 30 can be pivoted about the first horizontal pivot axis 32 by means of the piston-cylinder unit 45.

On the front side facing away from the bearing blocks 40 and 43, the supporting part 30 carries a supporting fork 48 with two prongs 49, 50 projecting forwards. The supporting fork 48 is held on the supporting bracket 36 for pivotal movement about a third pivot axis 52 oriented parallel to the longitudinal axis 34 of the vehicle and can be pivoted together with the supporting bracket 36 about the first horizontal pivot axis 32.

The prongs 49 and 50 each comprise at their free end a vertically upwardly projecting pin 53, 54.

In addition to the supporting part 30, there are held on the chassis 14 on either side of the supporting part 30 fastening elements in the form of a first retaining lug 56 and a second retaining lug 57. The retaining lugs 56 and 57 serve to fasten tension members in the form of a first chain 58 and a second chain 59.

Figure 4:
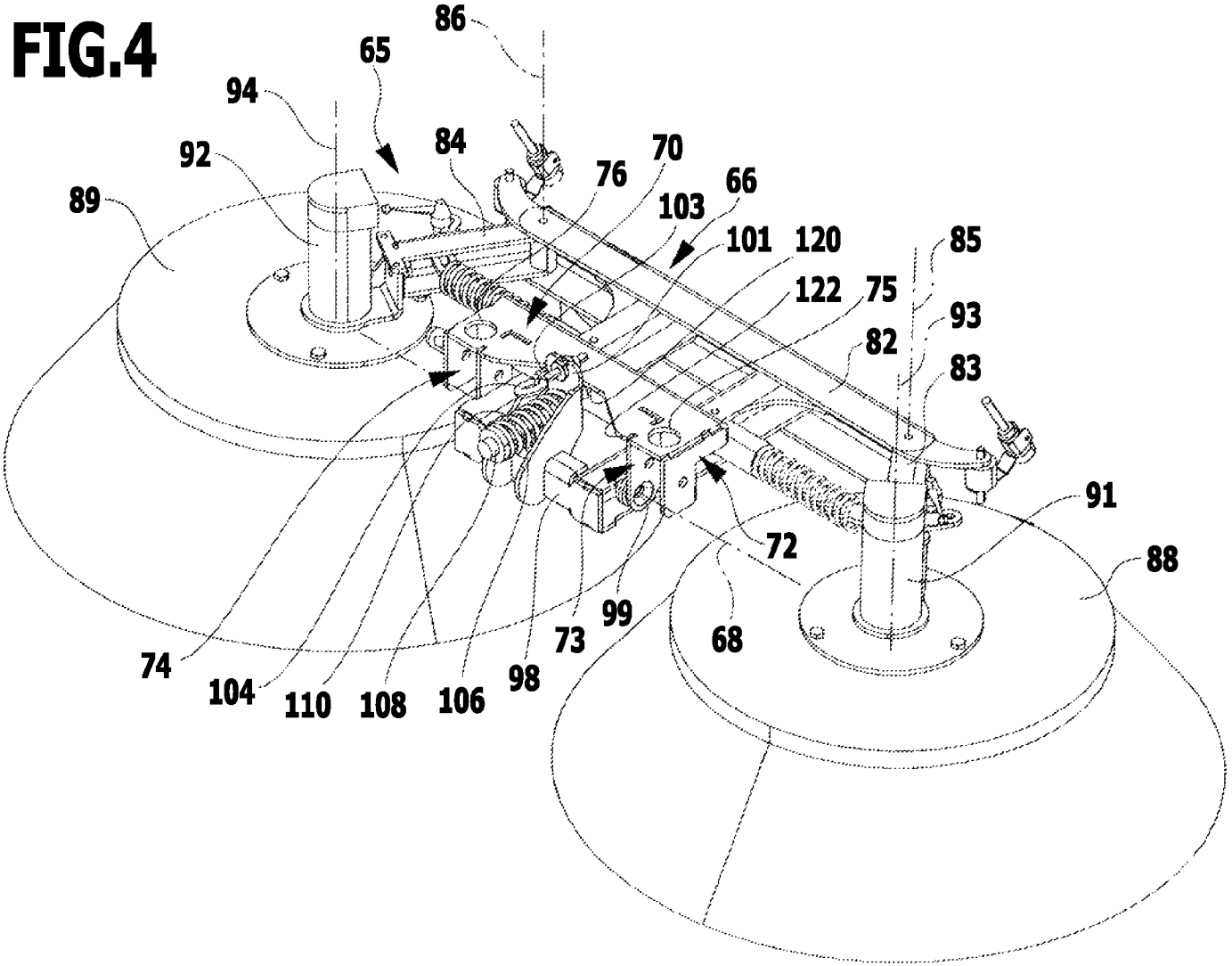
FIG. 4 shows a perspective representation of the sweeping brush device from FIG. 1.
Figure 5:
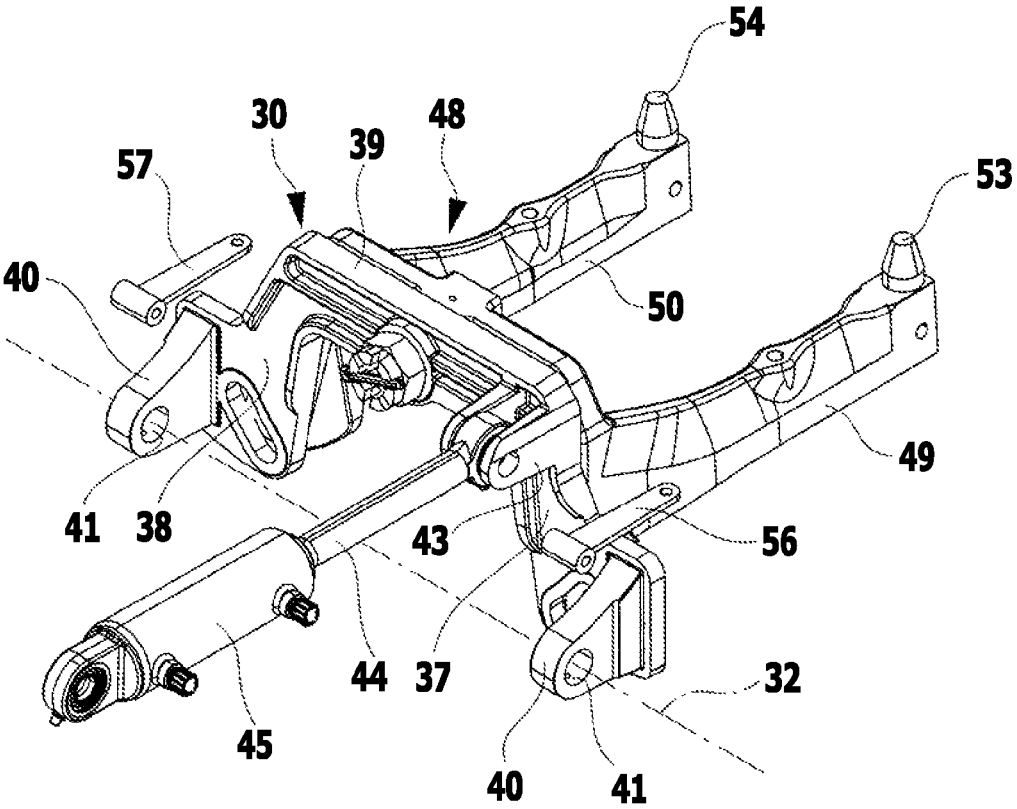
FIG. 5 shows a perspective representation of the supporting fork from FIG. 1.

The supporting fork 48 receives a sweeping brush device 65. This comprises a first supporting assembly 66, which is mounted so as to swing on a second supporting assembly 70 and for pivotal movement about a second horizontal pivot axis 68. The second horizontal pivot axis 68 is oriented parallel to the first horizontal pivot axis 32. The second supporting assembly 70 can be detachably connected to the supporting fork 48. For this purpose, the second supporting assembly 70 comprises a transverse member 72, which defines two U-shaped receptacles 73, 74 and has above each of the receptacles 73, 74 an opening 75 and 76, respectively. This will be clear, in particular, from FIG. 4.

The transverse member 72 may be placed on the end regions of the prongs 49 and 50 of the supporting fork 48. The pins 53 and 54 then each pass through an opening 75 and 76, respectively, and the receptacles 73 and 74 receive an end region of the prongs 49 and 50, respectively. The transverse member 72 can be secured to the prongs 49 and 50 of the supporting fork 48 by securing bolts 78, 79.

The first supporting assembly 66 comprises a first cross member 82, which is oriented parallel to the second horizontal pivot axis 68 and carries at each of its ends a retaining arm 83 and 84, respectively, which is pivotable about a vertically oriented pivot axis 85 and 86, respectively. A sweeping brush in the form of a disc brush 88 and 89, respectively, is held at the free end of each of the holding arms 83 and 84. The disc brushes 88 and 89 can each be set in rotation about an axis of rotation 93 and 94, respectively, of the brush, which is inclined slightly to the vertical, by a hydraulic motor 91 and 92, respectively.

The first cross member 82 is rigidly connected to two longitudinal members 96, 97 oriented parallel to the longitudinal axis 34 of the vehicle and coupled to each other at their ends facing away from the first cross member 82 by a second cross member 98. Between the first cross member 82 and the second cross member 98, the two longitudinal members 96 and 97 are each rotatably connected by ball pins 99 to the transverse member 72 of the second supporting assembly 70. The first supporting assembly 66 is thereby held on the second supporting assembly 70 so as to swing about the second horizontal pivot axis 68.

There projects from the second cross member 98, oriented transversely to the longitudinal axis of the latter, a tension mechanism holder 101, which is screwed at its free end to a screw 103 forming an eyelet 104 via which the two chains 58 and 59 can be connected to the tension mechanism holder 101 of the first supporting assembly 66.

There passes through the tension mechanism holder 101 a spring bolt 106, which is oriented parallel to the longitudinal axis 34 of the vehicle and is rigidly connected to the transverse member 72 of the second supporting assembly 70. It carries a bolt head 108 at its free end. There is clamped between the bolt head 108 and the tension mechanism holder 101 a spring element which is configured as a helical line-shaped compression spring 110. The compression spring 110 is supported via the spring bolt 106 on the second supporting assembly 70 and via the tension mechanism holder 101 on the first supporting assembly 66 and thus applies from the second supporting assembly 70 rigidly coupled to the supporting fork 48 a spring force and hence a torque to the first supporting assembly 66. The first supporting assembly 66 can be pivoted about the second horizontal pivot axis 68 against the spring-elastic restoring force applied by the compression spring 110. The strength of the restoring force applied by the compression spring 110 can be set by turning the spring bolt 106 screwed to the transverse member 72. The compression spring 110 prescribes, in the operating position of the disc brushes 88, 89 in which these are lowered onto the ground surface that is to be cleaned, the contact pressure which the disc brushes 88, 89 exert on the ground surface. For this purpose, the torque applied by the compression spring 110 to the first supporting assembly 66 counteracts the torque applied by the disc brushes 88, 89 on account of their weight. The torque of the compression spring 110 compensates the torque of the disc brushes 88, 89 except for a desired remaining amount which determines the desired contact pressure.

Figure 6:
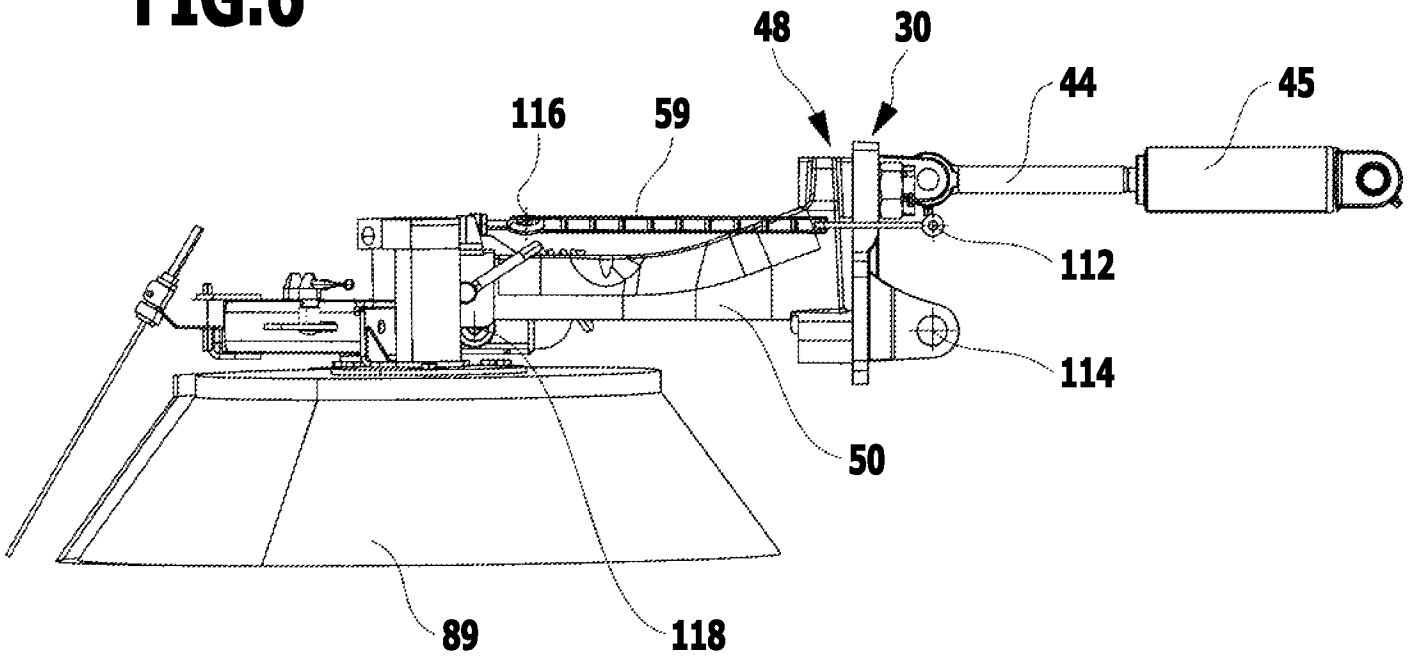
FIG. 6 shows a side view of the supporting fork with the sweeping brush device from FIG. 1 held detachably on it.

As will be clear, in particular, from FIG. 6, the chains 58, 59 form in combination with the supporting part 30 and the supporting fork 48 and also the first supporting assembly 66 and the second supporting assembly 70 a parallelogram guide for the two disc brushes 88, 89. That is to say, in the region of the chassis 14, the two chains 58 and 59 each define a first articulation point 112, and the bearing blocks 40 of the supporting bracket 36 form in the region of the chassis 14 a second articulation point 114. In the region of the sweeping brush device 65, the chains 58, 59 are coupled at a third articulation point 116 to the first supporting assembly 66. The second supporting assembly 70 rigidly coupled to the prongs 49, 50 of the supporting fork 48 is coupled at a fourth articulation point 118 in the form of the ball pins 99 to the first supporting assembly 66.

During operation of the sweeper 10, the disc brushes 88, 89 assume a sweeping position in which they act upon the ground surface that is to be cleaned with a contact pressure prescribable by the position of the spring bolt 106. When, starting from the sweeping position, the supporting fork 48 is pivoted by the piston-cylinder unit 45 about the first horizontal pivot axis 32, the disc brushes 88, 89 are raised parallel to the ground surface, i.e., the orientation of the axes of rotation 93, 94 of the brushes relative to the vertical remains unchanged. The inclination of the first supporting assembly 66 relative to the second supporting assembly 70 changes when the supporting fork 48 is pivoted. Since the first supporting assembly 66 executes a pivotal movement about the second horizontal pivot axis 68, the tension mechanism holder 101 increasingly approaches a stop 120 formed by the transverse member 72 and arranged between the two receptacles 73, 74 on the rear side 122 of the transverse member 72 that faces the chassis 14. When the tension mechanism holder 101 reaches the stop 120, in the event of continuous pivotal movement of the supporting fork 48 about the first horizontal pivot axis 32, the first supporting assembly 66 is unable to execute further pivotal movement about the second horizontal pivot axis 68, rather, the first supporting assembly 66 now follows the pivotal movement of the second supporting assembly 70, so that the disc brushes 88, 89 are now also pivoted about the first horizontal pivot axis 32, and, therefore, the inclination of the axes of rotation 93, 94 of the brushes relative to the vertical changes until they assume their position of rest in the fully upwardly pivoted position of the supporting fork 48.

Starting from the position of rest, the disc brushes 88, 89 can resume their operating position by pivoting of the supporting fork 48 in the opposite direction about the first horizontal pivot axis. Here they first execute a pivotal movement about the first horizontal pivot axis 32 until the tension mechanism holder 101, owing to its coupling via the chains 58, 59 to the chassis 14, lifts off from the stop 120, so that upon further lowering of the supporting fork 48, the disc brushes 88, 89 are moved downwards parallel to the ground surface with the orientation of the axes of rotation 93, 94 of the brushes remaining the same.

The entire sweeping brush device 65 can be connected in a very simple way to the supporting fork 48 and the chains 58, 59. As explained above, to do so, it is merely necessary to place the transverse member 72 of the second supporting assembly 70 on the free ends of the prongs 49, 50, with the pins 53, 54 passing through the openings 75 and 76, respectively. The transverse member 72 can then be secured to the supporting fork 48 by the securing bolts 78, 79. It is then only necessary to fasten the chains 58, 59 to the eyelet 104 of the screw 103 of the tension mechanism holder 101. No further measures are required for connecting the sweeping brush device 65 to the supporting fork 48. It is, therefore, also possible for inexperienced staff to make the connection within a very short time.

The invention claimed is:

1. Exchangeable sweeping brush device for a carrier vehicle, comprising:

a supporting frame; and at least one sweeping brush which is rotationally drivable about an almost vertically oriented axis of rotation of the at least one sweeping brush and is held on the supporting frame, the supporting frame together with the at least one sweeping brush mounted thereon being detachably connectable to a supporting fork of the carrier vehicle, the supporting fork being mounted on a supporting part of the carrier vehicle, the supporting fork together with the supporting part being pivotable with respect to a chassis of the carrier vehicle about a first horizontal pivot axis oriented transversely to a longitudinal axis of the carrier vehicle;

the supporting frame comprising a first supporting assembly on which the at least one sweeping brush is mounted for rotation, and a second supporting assembly which is detachably connectable to the supporting fork;

the first supporting assembly being connected to the second supporting assembly for pivotal movement about a second horizontal pivot axis and being detachably connectable to the carrier vehicle by at least one tension member;

wherein:

the supporting fork comprises two substantially symmetrical prongs and a bridge part connecting the two prongs, the two prongs extending longitudinally and in spaced relation to one another parallel to the longitudinal axis, the bridge part being oriented transversely to the longitudinal axis, the bridge part is mounted on the supporting part for pivotal movement about a third pivot axis oriented transverse to the first horizontal pivot axis and the second horizontal pivot axis;

the second supporting assembly comprises a transverse member, which is detachably placed on and transversely spans between corresponding free end regions of the two prongs of the supporting fork, and on which the first supporting assembly is mounted for pivotal movement about the second horizontal pivot axis;

the transverse member comprises two receptacles each of which directly receives one of the corresponding free end regions of the two prongs of the supporting fork;

the first supporting assembly is pivotable about the second horizontal pivot axis against a spring-elastic restoring force;

a strength of the spring-elastic restoring force is adjustable; and the spring-elastic restoring force is applied by a spring element which is clamped between the first supporting assembly and the second supporting assembly.

2. Exchangeable sweeping brush device in accordance with claim 1, wherein a contact pressure which the at least one sweeping brush exerts on a ground surface that is to be cleaned is adjustable.

3. Exchangeable sweeping brush device in accordance with claim 1, wherein the first supporting assembly comprises a tension member holder, which is connectable to the tension member at a distance from the second horizontal pivot axis, and which is coupled by the spring element to the second supporting assembly.

4. Exchangeable sweeping brush device in accordance with claim 3, wherein the spring element is configured as a compression spring.

5. Exchangeable sweeping brush device in accordance with claim 4, wherein a spring force of the compression spring is adjustable.

6. Exchangeable sweeping brush device in accordance with claim 1, wherein a pivotability of the first supporting assembly is limited.

7. Exchangeable sweeping brush device in accordance with claim 6, wherein the second supporting assembly comprises a stop against which the first supporting assembly comes to bear when the first supporting assembly reaches a maximum pivot angle.

8. Exchangeable sweeping brush device in accordance with claim 1, wherein the at least one sweeping brush comprises two sweeping brushes.

9. Exchangeable sweeping brush device in accordance with claim 8, wherein the first supporting assembly comprises a first cross member, at each end of which a retaining arm, each retaining arm carrying one of the two sweeping brushes, is mounted for pivotal movement about a vertical pivot axis.

10. Exchangeable sweeping brush device in accordance with claim 9, wherein the first cross member is rigidly connected to two longitudinal members, which are mounted on the second supporting assembly for pivotal movement about the second horizontal pivot axis.

11. Exchangeable sweeping brush device in accordance with claim 10, wherein the two longitudinal members are rigidly connected to each other by a second cross member, with the second horizontal pivot axis extending between the first cross member and the second cross member.

12. Exchangeable sweeping brush device in accordance with claim 11, wherein the second cross member is rigidly connected to a tension member holder, the at least one tension member being connectable to a free end of the tension member holder projecting from the second cross member.

13. Exchangeable sweeping brush device in accordance with claim 12, wherein the tension member holder is adapted to bear against a stop of the second supporting assembly after pivoting of the first supporting assembly through a maximum pivot angle.

14. Exchangeable sweeping brush device in accordance with claim 1, wherein the first supporting assembly is held on the second supporting assembly so as to swing about the second horizontal pivot axis.

15. Exchangeable sweeping brush device in accordance with claim 1, wherein the transverse member forms a stop which limits pivotability of the first supporting assembly.

16. Exchangeable sweeping brush device in accordance with claim 1, wherein the transverse member carries a spring holder which is coupled to the first supporting assembly by the spring element.

17. Sweeper, comprising:

a chassis of a carrier vehicle;

a supporting fork coupled to the chassis, the supporting fork being pivotable with respect to the chassis about a first horizontal pivot axis oriented transversely to a longitudinal axis of the carrier vehicle; and a sweeping brush device which is detachably connectable to the supporting fork and has at least one sweeping brush which is rotationally drivable about an almost vertically oriented axis of rotation of the at least one sweeping brush and is held on a supporting frame, the supporting frame together with the at least one sweeping brush mounted thereon being detachably connectable to a supporting fork of the carrier vehicle, the supporting fork being pivotable about a first horizontal pivot axis oriented transversely to the longitudinal axis of the carrier vehicle;

the supporting frame comprising a first supporting assembly on which the at least one sweeping brush is mounted for rotation, and a second supporting assembly which is detachably connectable to the supporting fork;

the first supporting assembly being connected to the second supporting assembly for pivotal movement about a second horizontal pivot axis and being detachably connectable to the carrier vehicle by at least one tension member; and wherein:

at least one fastening element is held on the chassis for connecting the at least one tension member to the chassis;

the supporting fork comprises two substantially symmetrical prongs and a bridge part connecting the two prongs, the two prongs extending longitudinally and in spaced relation to one another parallel to the longitudinal axis, the bridge part being oriented transversely to the longitudinal axis, the bridge part is mounted on the supporting part for pivotal movement about a third pivot axis oriented transverse to the first horizontal pivot axis and the second horizontal pivot axis;

the second supporting assembly comprises a transverse member, which is detachably placed on and transversely spans between corresponding free end regions of the two prongs of the supporting fork, and on which the first supporting assembly is mounted for pivotal movement about the second horizontal pivot axis;

the transverse member comprises two receptacles each of which directly receives one of the corresponding free end regions of the two prongs of the supporting fork;

the first supporting assembly is pivotable about the second horizontal pivot axis against a spring-elastic restoring force;

a strength of the spring-elastic restoring force is adjustable;

the spring-elastic restoring force is applied by a spring element which is clamped between the first supporting assembly and the second supporting assembly; and a supporting part is held on the chassis for pivotal movement about the first horizontal pivot axis together with the supporting fork.

* * * * *